US011035606B2

(12) United States Patent
Simpson et al.

(10) Patent No.: US 11,035,606 B2
(45) Date of Patent: Jun. 15, 2021

(54) FAN MOUNTING ASSEMBLY, EVAPORATOR COIL COVER AND AIR TOWER OF REFRIGERATOR

(71) Applicant: Electrolux Home Products, Inc., Charlotte, NC (US)

(72) Inventors: Cory Dale Simpson, Abbeville, SC (US); Benjamin Mobley, Iva, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 270 days.

(21) Appl. No.: 16/018,516

(22) Filed: Jun. 26, 2018

(65) Prior Publication Data

US 2018/0299188 A1 Oct. 18, 2018

Related U.S. Application Data

(62) Division of application No. 14/497,220, filed on Sep. 25, 2014, now Pat. No. 10,101,077.

(51) Int. Cl.

| | |
|---|---|
| ***F25D 23/06*** | (2006.01) |
| ***F25D 17/06*** | (2006.01) |
| ***F04D 29/60*** | (2006.01) |

(52) U.S. Cl.

CPC ..... *F25D 23/062* (2013.01); *F04D 29/601* (2013.01); *F25D 17/062* (2013.01); *F25D 17/067* (2013.01); *F25D 2317/067* (2013.01); *F25D 2317/068* (2013.01); *F25D 2317/0681* (2013.01)

(58) Field of Classification Search

CPC ..... F25D 17/04; F25D 17/042; F25D 17/045; F25D 17/06; F25D 17/062; F25D 17/065; F25D 17/067; F25D 17/08; F25D 23/062; F25D 2317/068; F25D 2317/067; F25D 2317/0681; F04D 29/601

USPC ..... 62/408

See application file for complete search history.

(56) References Cited

U.S. PATENT DOCUMENTS

| | | | |
|---|---|---|---|
| 3,020,733 | A | 2/1963 | Hubacker et al. |
| 3,103,109 | A | 9/1963 | Krug et al. |
| 3,365,118 | A | 1/1968 | Winfield, Jr. |
| 3,834,176 | A | 9/1974 | Clarke |
| 3,992,171 | A | 11/1976 | Jenewein |
| 4,208,884 | A | 6/1980 | Popham |

(Continued)

FOREIGN PATENT DOCUMENTS

| | | |
|---|---|---|
| WO | 2014202142 | 12/2014 |

*Primary Examiner* — Steve S Tanenbaum

(74) *Attorney, Agent, or Firm* — Pearne & Gordon LLP

(57) ABSTRACT

A refrigeration appliance comprises a fan mounting assembly mountable to a liner of a cabinet. The fan mounting assembly comprises a bracket, a first member of a first snap coupling on the bracket for receiving a corresponding second member of the first snap coupling on an evaporator coil cover, and a mounting flange having a first member of a snap lock extending from the bracket for mounting the fan mounting assembly to the liner of the cabinet. An evaporator coil cover for mounting to the fan mounting assembly comprises a second member of the first snap coupling allowing the evaporator coil cover to be coupled to the fan mounting assembly, and a first slot. An air tower assembly mountable to the fan mounting assembly through the first slot comprises a second member of a second snap coupling and a second member of a third snap coupling.

9 Claims, 9 Drawing Sheets

(56) References Cited

U.S. PATENT DOCUMENTS

| | | | | | |
|---|---|---|---|---|---|
| 4,509,335 | A | | 4/1985 | Griffin et al. | |
| 4,704,874 | A | | 11/1987 | Thompson et al. | |
| 4,920,765 | A | | 5/1990 | McCauley et al. | |
| 4,944,157 | A | | 7/1990 | Jenkins et al. | |
| 5,369,963 | A | * | 12/1994 | Pickles | F25D 17/045 62/408 |
| 5,727,859 | A | * | 3/1998 | Jeong | F25D 23/006 312/404 |
| 5,758,512 | A | | 6/1998 | Peterson et al. | |
| 5,797,164 | A | | 8/1998 | Donaghy | |
| 5,819,552 | A | | 10/1998 | Lee | |
| 5,911,750 | A | | 6/1999 | Mandel et al. | |
| 6,732,537 | B1 | | 5/2004 | Anell et al. | |
| 6,823,689 | B2 | | 11/2004 | Kim et al. | |
| 6,918,259 | B2 | | 7/2005 | Anderson et al. | |
| 7,051,539 | B2 | | 5/2006 | Junge et al. | |
| 7,299,651 | B2 | | 11/2007 | Oh | |
| 7,317,267 | B2 | | 1/2008 | Schmid | |
| 7,559,211 | B2 | | 7/2009 | Revlett | |
| 7,895,843 | B1 | | 3/2011 | Hawkins | |
| RE42,687 | E | | 9/2011 | Yoon | |
| 8,359,880 | B2 | | 1/2013 | Lee | |
| 8,484,987 | B2 | | 7/2013 | Ducharme et al. | |
| 8,511,106 | B2 | | 8/2013 | Ducharme et al. | |
| 2006/0165482 | A1 | | 7/2006 | Olberding | |
| 2010/0064719 | A1 | | 3/2010 | Lee | |
| 2010/0218520 | A1 | | 9/2010 | McCollough et al. | |
| 2010/0218535 | A1 | | 9/2010 | Candeo | |
| 2012/0047934 | A1 | | 3/2012 | Park et al. | |
| 2012/0272670 | A1 | | 11/2012 | Choi et al. | |
| 2016/0091238 | A1 | | 3/2016 | Simpson | |
| 2016/0146224 | A1 | | 5/2016 | Mutlu Bozay | |
| 2016/0231045 | A1 | | 8/2016 | Wait | |

* cited by examiner

FAN MOUNTING ASSEMBLY, EVAPORATOR COIL COVER AND AIR TOWER OF REFRIGERATOR

CROSS-REFERENCE TO RELATED APPLICATIONS

This application is a divisional of U.S. application Ser. No. 14/497,220, filed on Sep. 25, 2014. This application is incorporated herein by reference.

BACKGROUND OF THE INVENTION

1. Field of the Invention

This application relates generally to refrigeration appliances, particularly to a fan mounting assembly mountable to a liner of a refrigeration appliance cabinet, an evaporator coil cover coupled to the fan mounting assembly, and a air tower coupled to the fan mounting assembly through the evaporator coil cover.

2. Description of Related Art

Refrigeration appliances, such as domestic refrigerators, typically have both a fresh food compartment and a freezer compartment or section. The fresh food compartment is where food items such as fruits, vegetables, and beverages are stored and the freezer compartment is where food items that are to be kept in a frozen condition are stored. The refrigerators are provided with a refrigeration system that maintains the fresh food compartment at temperatures above 0° C. and the freezer compartments at temperatures below 0° C.

Such refrigerators are often provided with an evaporator fan motor powering a fan for urging air over the evaporator coil.

SUMMARY

According to one aspect, the subject application involves a refrigeration appliance having a fan mounting assembly mounted to a liner of the freezer compartment. The fan mounting assembly comprises a bracket enclosing a fan and a fan motor, and an opening for fan blades. At least one mounting flange extends from the bracket for mounting the fan mounting assembly to the liner of the refrigeration appliance cabinet. A snap lock having a first member and a second member is provided at the flange. In one embodiment, the first member of the snap lock is a molded female dovetail feature having a snap tongue extending from one end of the female dovetail, and the corresponding second member of the snap lock is a male dovetail projecting from the liner into the refrigeration appliance cabinet. When snapped together, the female dovetail is captured by the male dovetail projection on three sides.

A first snap coupling having a first member and a second member is provided on a base panel of the mounting bracket. The first snap coupling includes corresponding structures on the base panel and the evaporator coil cover. In one embodiment, the first member of the first snap coupling is a notched tab on the base panel that extends into the freezer compartment, and the corresponding second member of the snap coupling on the evaporator coil cover is a snap hole. The first snap coupling serves to snap the evaporator coil cover to the mounting assembly.

A second snap coupling having a first member and a second member is provided on the base panel of the mounting bracket. The second snap coupling includes corresponding structures on the base panel and on an air tower assembly. In one embodiment, the first member of the second snap coupling is a snap hole provided on the base panel of the mounting assembly, and the second member of the second snap coupling is mounting hook on the air tower. The second snap coupling serves to fasten the air tower assembly to the mounting assembly through additional slots provided in the evaporator coil cover.

A third snap coupling having a first member and a second member is provided on the base panel of the mounting bracket. The third snap coupling includes corresponding structures on the base panel and the air tower assembly. In one embodiment, the first member of the third snap coupling is a snap clip provided on the upper side of the fan mounting assembly, and the corresponding second member of the third snap coupling is a snap hole on the upper side of the air tower assembly. The third snap coupling also serves to fasten the air tower assembly to the mounting assembly through additional slots provided in the evaporator coil cover.

According to another aspect, the subject application involves a refrigeration appliance that includes an evaporator coil cover for a freezer compartment of a refrigerator. A first snap coupling having a first member and a second member is provided on the evaporator coil cover. The first snap coupling includes corresponding structures on the base panel and the evaporator coil cover. In one embodiment, the first member of the first snap coupling is a notched tab on the base panel that extends into the freezer compartment, and the corresponding second member of the snap coupling on the evaporator coil cover is a snap hole. The first snap coupling serves to snap the evaporator coil cover to the mounting assembly.

A first slot is provided in the evaporator coil cover to enable the engagement of the respective members of the second snap couplings on the fan mounting assembly and the air tower. In one embodiment, a second slot is also provided in the evaporator coil cover to enable the engagement of the respective members of the third snap couplings on the fan mounting assembly and the air tower. The evaporator coil cover has an opening for fan blades that is at least partially overlapping the opening of the fan mounting assembly for the fan blades. In one embodiment, the opening on the evaporator coil cover is coaxial with the opening of the fan mounting assembly.

In one embodiment, the evaporator coil cover further comprises a flange extending downwards from the evaporator coil cover that is insertable into a recess in the bottom of the refrigeration appliance cabinet at a tilt.

In another embodiment, the evaporator cover further comprises a screw hole corresponding in position to a tapped hole on a kidney area of the liner of the refrigeration appliance cabinet for securing the evaporator cover to the liner.

According to yet another aspect, the subject application involves an air tower assembly of a refrigerator that serves to distribute cool air discharged from an evaporator fan throughout a freezer and fresh food compartment of the refrigerator. A second snap coupling having a first member and a second member is provided on the air tower. The second snap coupling includes corresponding structures on the base panel and on an air tower assembly. In one embodiment, the first member of the second snap coupling is a snap hole provided on the base panel of the mounting assembly, and the second member of the second snap coupling is mounting hook on the air tower. The second snap coupling serves to fasten the air tower assembly to the mounting assembly through additional slots provided in the evaporator coil cover.

In another embodiment, the air tower assembly further comprises a third snap coupling having a first member and a second member. The third snap coupling includes corresponding structures on the base panel and the air tower assembly. In one embodiment, the first member of the third snap coupling is a snap clip provided on the upper side of the fan mounting assembly, and the corresponding second member of the third snap coupling is a snap hole on the upper side of the air tower assembly. The third snap coupling also serves to fasten the air tower assembly to the mounting assembly through additional slots provided in the evaporator coil cover.

In another embodiment, the snap clip extends upwardly from the fan mounting assembly. In yet another embodiment, the mounting hook extends perpendicularly from the air tower assembly towards a base panel of the fan mounting assembly.

In another embodiment, the air tower assembly further comprises a flange that is insertable into an opening in an air duct of the refrigeration appliance that is in fluid communication with a second refrigeration appliance cabinet, to thereby permit air flow from the refrigeration appliance cabinet to the second refrigeration appliance cabinet.

In another embodiment, the air tower assembly is made out of polyethylene material.

BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

DETAILED DESCRIPTION

Figure 1:
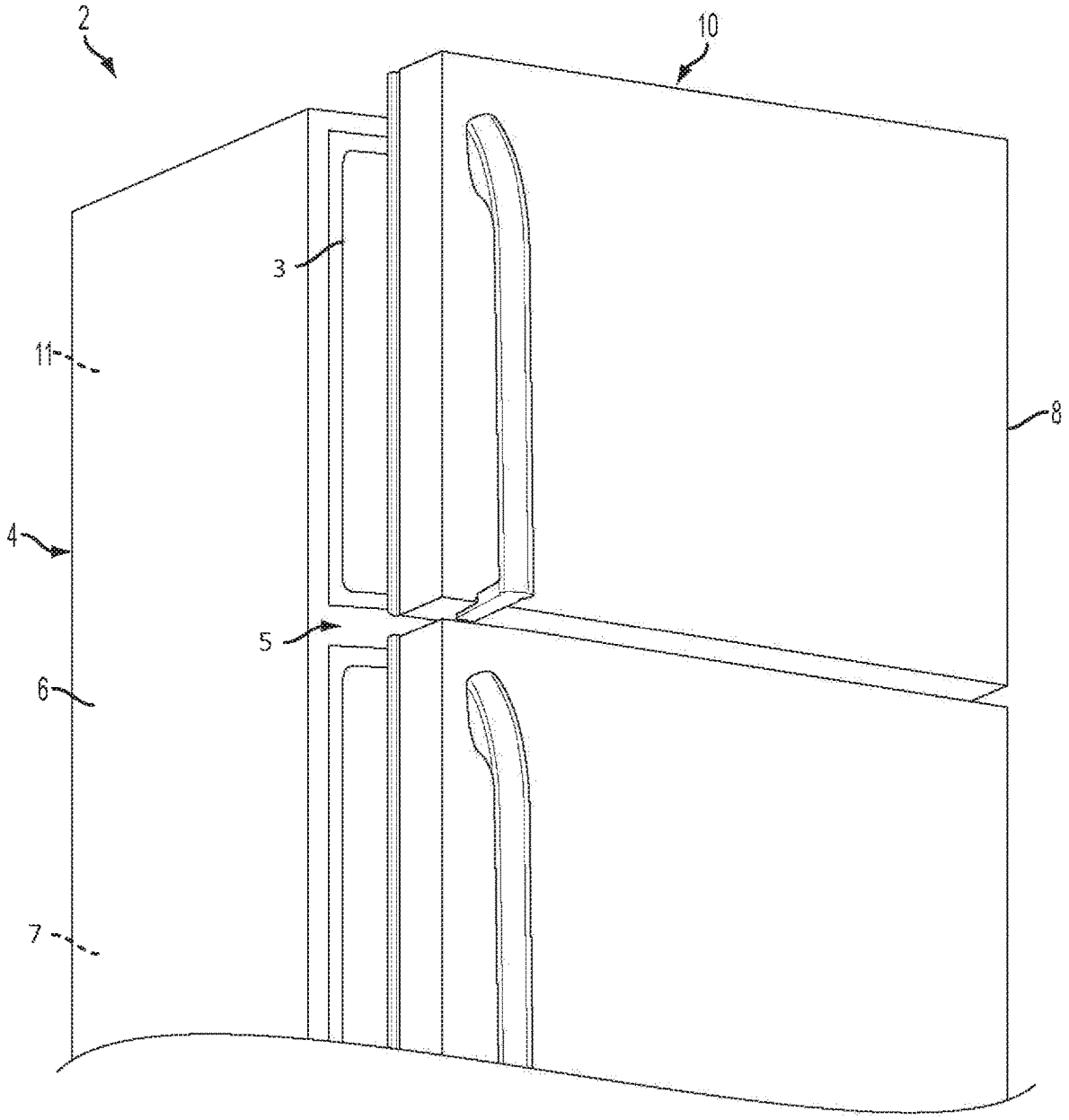
FIG. 1 is a perspective view of a top mount refrigerator.

Certain terminology is used herein for convenience only and is not to be taken as a limitation on the present invention. Relative language used herein is best understood with reference to the drawings, in which like numerals are used to identify like or similar items. Further, in the drawings, certain features may be shown in somewhat schematic form.

The phrase "at least one of", if used herein followed by a plurality of members, means one of the members or a combination of more than one of the members. For example, the phrase "at least one of a first snap coupling and a second snap coupling" means in the present application: the first snap coupling, the second snap coupling, or the first snap coupling and the second snap coupling. Likewise, "at least one of a first snap coupling, a second snap coupling and a third snap coupling" means in the present application: the first snap coupling, the second snap coupling, the third snap coupling, the first snap coupling and the second snap coupling, the first snap coupling and the third snap coupling, the second snap coupling and the third snap coupling, or the first snap coupling and the second snap coupling and the third snap coupling.

Turning to the shown example of FIG. 1, a refrigeration appliance in the form of a refrigerator 2 is illustrated as a top-mount refrigerator with freezer and fresh food compartments. While the present application is described herein by way of attaching a fan mounting assembly, a coil cover and a fan tower to the liner of an example refrigeration appliance, it is contemplated that various other appliances could also be used, such as stoves, microwaves, stand-alone refrigerators, or freezers, as well as other configurations of combined refrigerator/freezers.

The arrangement of the fresh food and freezer compartments with respect to one another in such refrigerators vary. For example, in some cases, the freezer compartment is located above the fresh food compartment (i.e., a top mount refrigerator), and in other cases the freezer compartment is located below the fresh food compartment (i.e. a bottom mount refrigerator). Additionally, many modern refrigerators have their freezer compartments and fresh food compartments arranged in a side-by-side relationship. Whatever arrangement of the freezer compartment and the fresh food compartment is employed, typically, separate access doors are provided for the refrigerated compartments so that either compartment may be accessed without exposing the other compartment to the ambient air. For example, a door provides access to the freezer compartment, and a door provides access to the fresh food compartment of the refrigerator. While the present application is described herein by way of an example top mount refrigerator configuration, it is contemplated that any refrigerator configuration can be used, such as bottom-mount refrigerators having at least one door.

Referring to FIG. 1, an insulated cabinet constructed in accordance with the present invention is generally indicated at 2. Cabinet 2 includes a cabinet shell 4 defined, at least in part, by first and second upstanding side panels 6 and 8 that are interconnected and laterally spaced by a top panel 10. Although not shown in this figure, cabinet shell 4 would also include a rear panel and internal reinforcing structure. A liner 3 inside the shell can define spaces. Foam insulation may be used between the cabinet shell 4 and the liner 3. Since refrigerator cabinet 2 represents a top mount-type refrigerator, a divider portion 5 is provided which extends laterally across shell 4 and divides refrigerator cabinet 2 into an upper space that can be used as a freezer compartment 11, and a lower space that can be used as a fresh food compartment 7. Alternatively, the divider portion 5 can divide the refrigerator cabinet 2 into an upper fresh food compartment, and a lower freezer compartment.

Referring to FIG. 2, there again is illustrated a refrigeration appliance in the form of a top-mount refrigerator appliance 2 having a freezer compartment 11 disposed vertically above a fresh-food compartment 7. Although an embodiment is described in detail below, and shown in the figures as a top-mount configuration of a refrigerator having a freezer compartment 11, the refrigerator can have any desired configuration including at least one cabinet 11, a fan 16 and evaporator coil disposed adjacent to the fan 16, without departing from the scope of the present invention.

Figure 2:
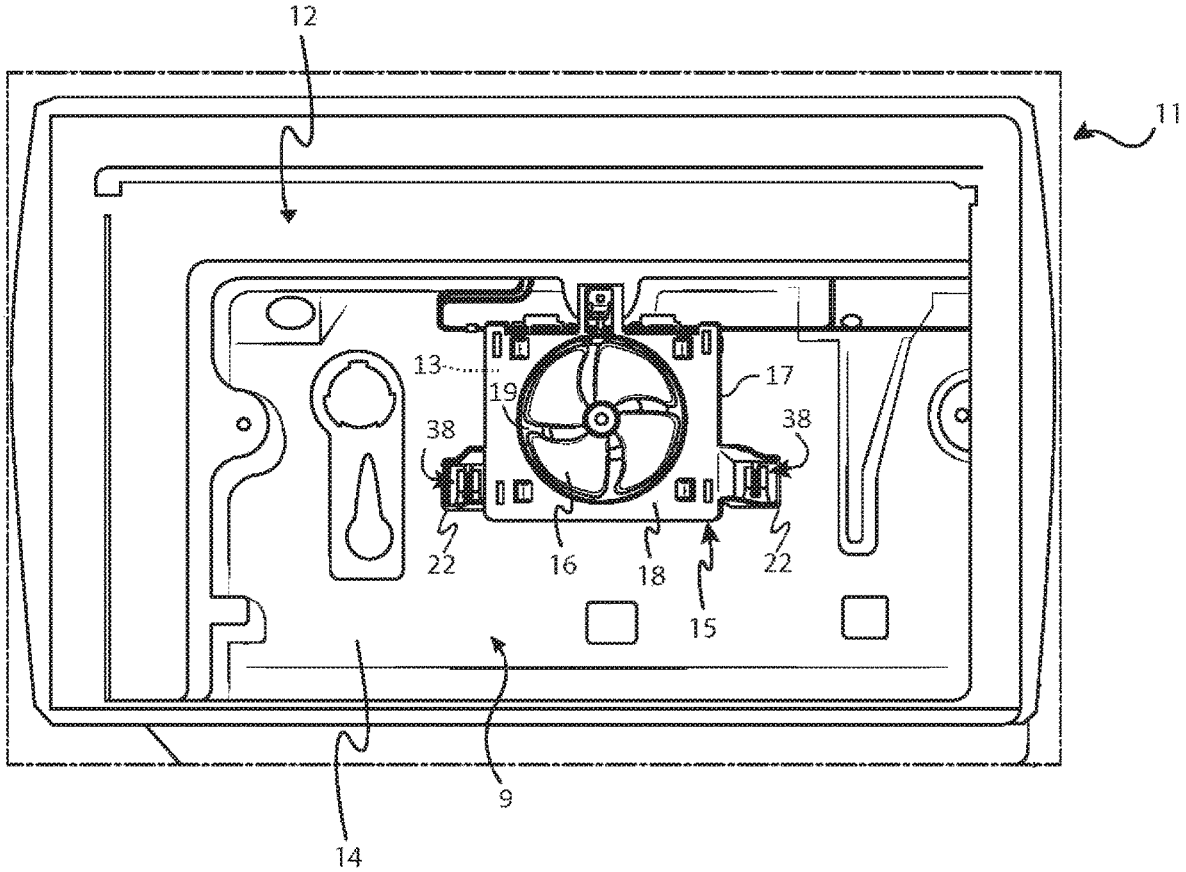
FIG. 2 shows a front view looking into a freezer compartment in which a fan mounting assembly is attached to a rear liner.

An interior 12 of the freezer compartment 11 shown in FIG. 2 is defined by a freezer liner having a rear liner 14. The rear liner 14 has a recess 9 and a mounting assembly 15 is mounted to the rear liner 14 in the recess 9. The mounting assembly 15 comprises a bracket 17 enclosing a housing portion 13 for receiving the fan 16 and a fan motor 31 (shown in FIG. 3). The bracket 17 has an opening 19 on a base panel 18 for receiving fan blades.

Figure 3A:
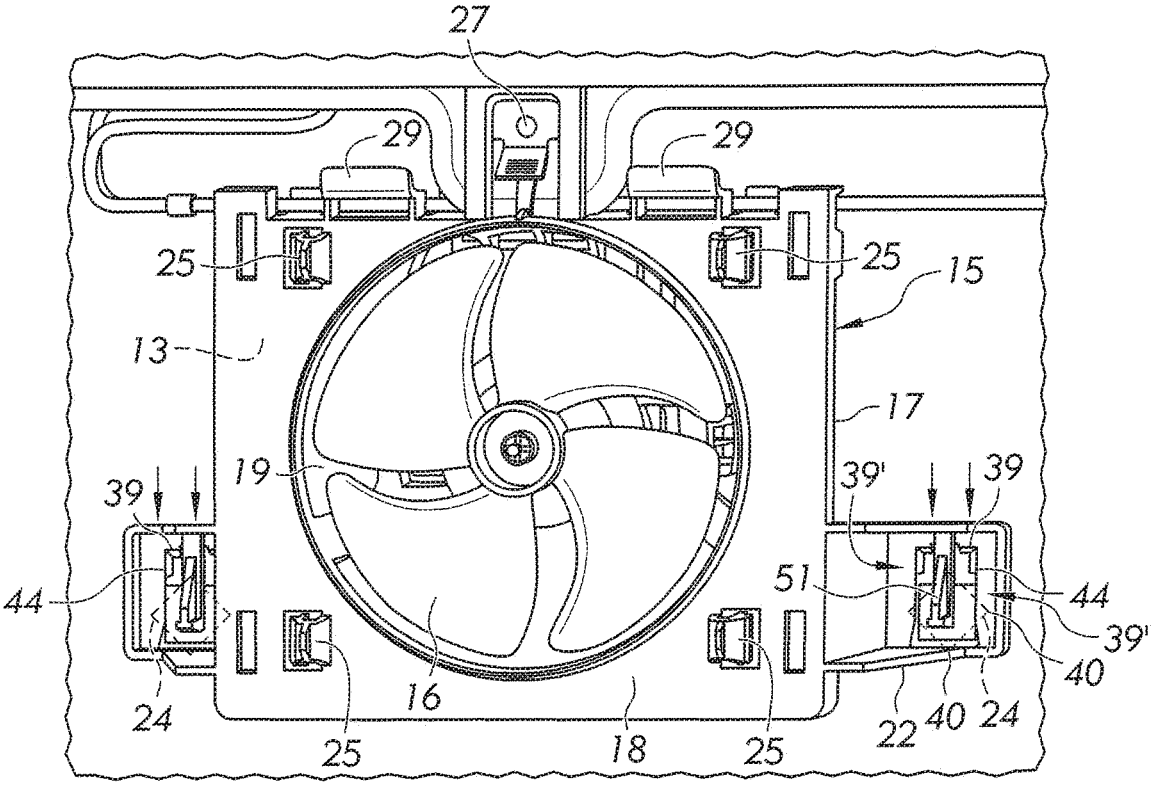
FIG. 3*a* is a front, detail view of an illustrative embodiment of the fan mounting assembly, when the female dovetail on the mounting flange is about to engage with the male dovetail on the liner.
Figure 3B:
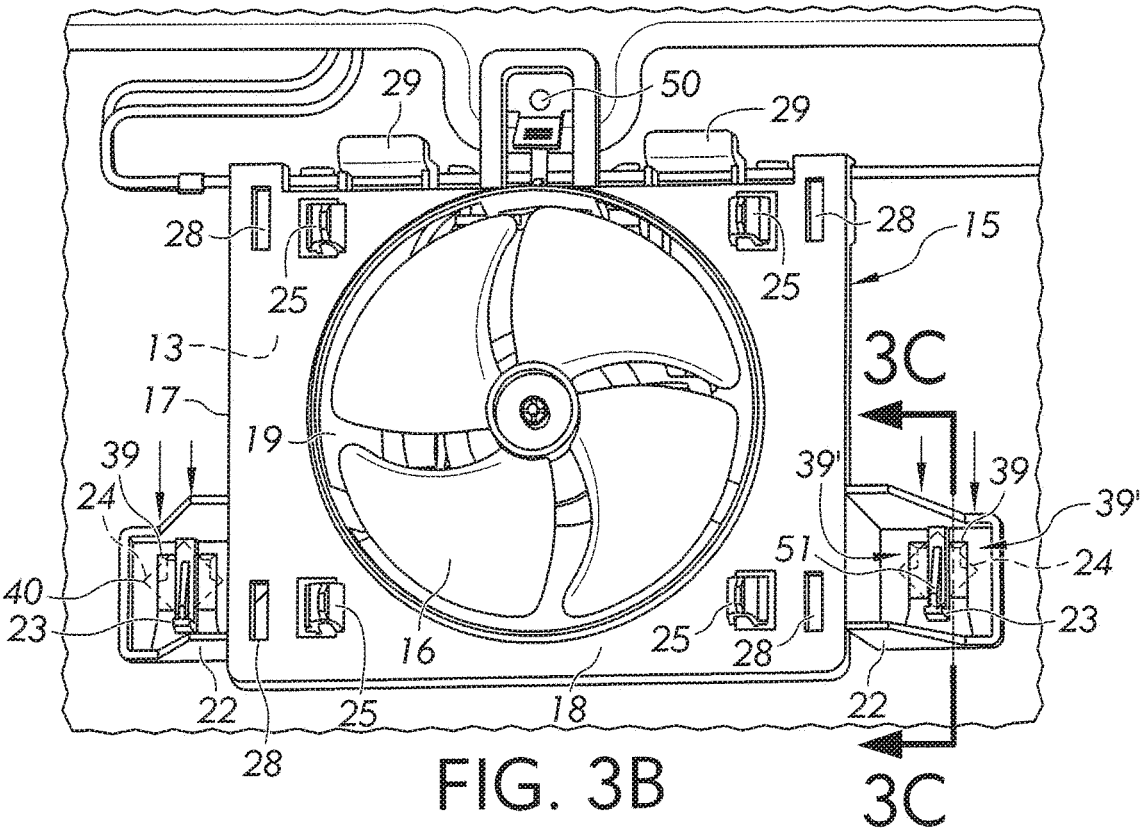
FIG. 3*b* is a front, detail view of an illustrative embodiment of the fan mounting assembly, wherein the female dovetail are cooperating with the male dovetail of the snap lock.
Figure 3C:
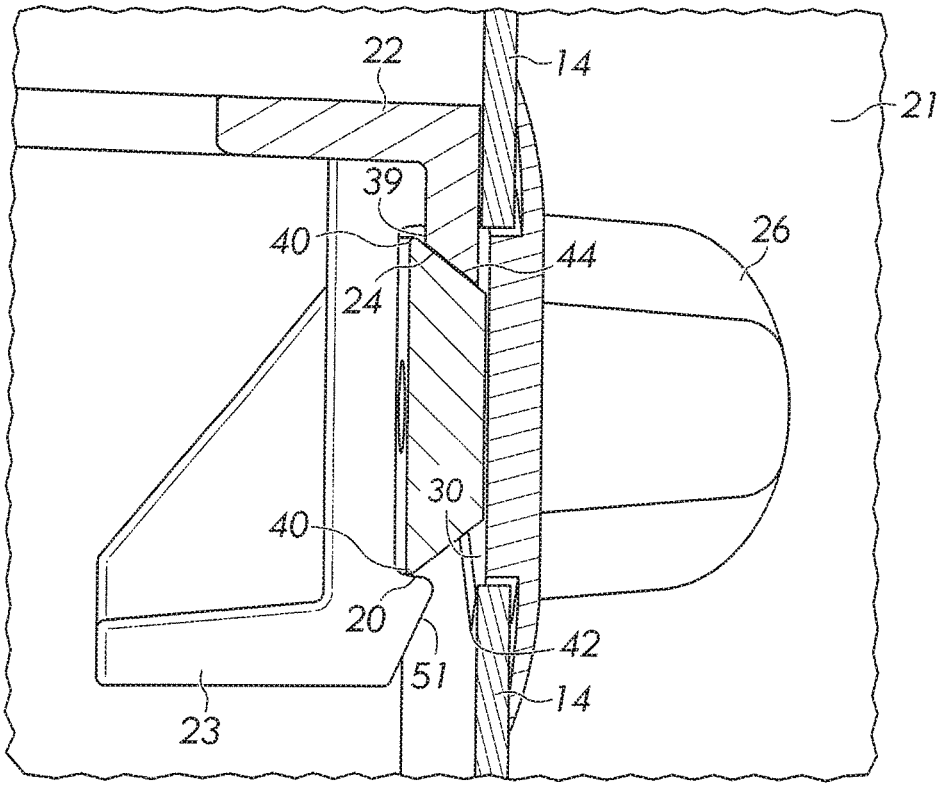
FIG. 3*c* is a fragmentary sectional view of a portion of an illustrative embodiment of the fan mounting assembly showing the relative positions of the female dovetail, particularly the snap tongue, and the male dovetail when the female dovetail are cooperating with the male dovetail of the snap lock, and taken along line 2-2 of FIG. 2*b;*

As shown in FIG. 2, the mounting assembly 15 has mounting flanges 22 on both sides of the bracket 17. A snap lock 38 having a first member and a second member is provided at each mounting flange 22. The snap lock includes corresponding structures on the bracket and liner that secure the bracket to the liner by pressing or sliding or rotating the bracket or part of the bracket relative to the liner. For example, as shown in FIG. 3*a*, the first member can be provided on the mounting flange 22 as a molded female dovetail 44 feature, for receiving the corresponding second member of the snap lock, such as a male dovetail 24 mounted on or molded into the rear liner 14. The male dovetail 24 projects into the interior of the freezer compartment 12. The female dovetail 44 has a snap tongue 23 extending from one end of the female dovetail. As shown in FIG. 3*c*, the snap tongue has a ramp 51 and a nose 20. The bracket 17 can be securely snapped to male dovetail 24 by first positioning the male dovetail 24 inside the molded female dovetail slots, and then sliding the bracket 17 downwards till a narrow upper portion 39 of the female dovetail 44 slides behind the male dovetail 24. The nose 20 rides over the male dovetail 24 till nose 20 of the snap tongue 23 engages the bottom of the male dovetail 24 to inhibit vertical movement of the flange 22. In comparing to FIG. 3*a*, FIG. 3*b* and FIG. 3*c* illustrates the relative positions of the female dovetail 44, particularly the snap tongue 23, and the male dovetail 24 when the male dovetail is locked inside the female dovetail. It can be seen in FIG. 2*c* that when snapped together, the female dovetail 44 of the bracket is captured by the male dovetail 24 projection on three sides. The snap tongue 23 further ensures the bracket 17 is locked to the male dovetail 24 in a vertical direction.

Once the bracket 17 is secured to the rear liner 14, a screw 50 (shown in FIG. 3*b*) can be inserted into a hole 27 in the bracket 17 and further into a corresponding tapped hole on the rear liner 14 to further secure the bracket 17 to the rear liner 14. The hole 27 in the bracket 17 is provided on a flange extending vertically from the base panel 18 of the bracket 17 (shown in FIG. 3*a*).

The male dovetail 24 can be mounted to the rear liner 14 by an toggle lock 26 attached to the male dovetail 24, as shown in FIG. 3*c*. To mount the male dovetail 24 to the rear liner 14, the following st can be taken: step one, align four corners 40 of the male dovetail 24 with four corners 42 of a diamond-shaped opening 30 on the rear liner 14; step two, insert the toggle lock 26 into the opening 30; step three, rotate the male dovetail 24 for 90 degrees either clockwise or counterclockwise till the four corners 40 rest immediately on top of the four edges 43 of the opening 30; step four, inject a controlled amount of insulation material 21 into the space between the rear liner 14 and the cabinet shell 4 till the insulation material fill out the entire space, including the area surrounding the toggle lock 26. When hardened, the insulation material 21 secures the toggle lock 26 and the male dovetail 24 in place. The edges 43 further provides a support to the male dovetail 24, ensures the male dovetail 24 stays in a vertical direction and prevents the male dovetail 24 from rotating.

It is contemplated that there can be another embodiment where the first member of the snap lock provided on the mounting flanges 22 is a male dovetail, whereas the corresponding second member of the snap lock is a female dovetail feature mounted on the rear liner 14 by a toggle lock 26.

Figure 4:
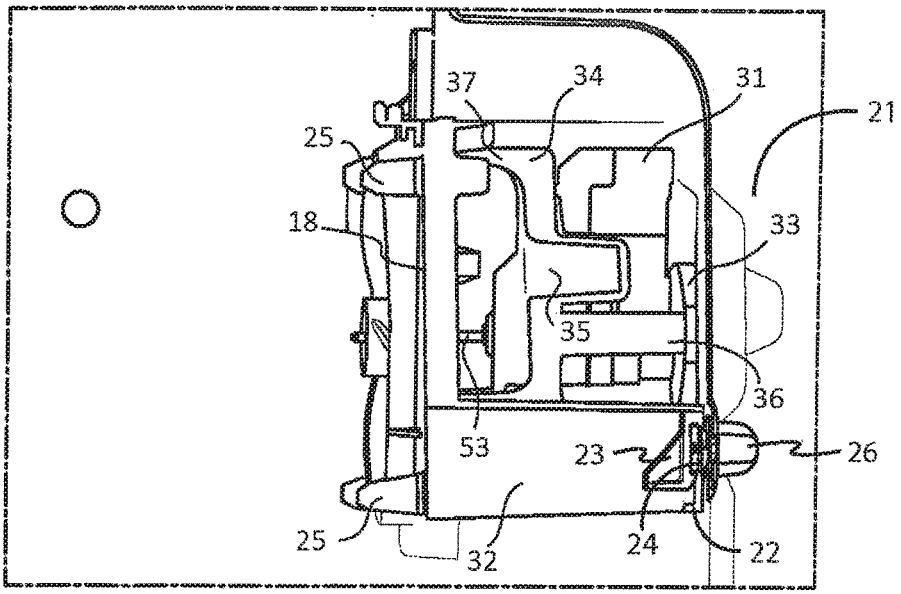
FIG. 4 shows a side view of an illustrative embodiment of the fan mounting assembly, wherein the female dovetail are cooperating with the male dovetail of the snap lock.

In one embodiment shown in FIG. 4, the mounting flanges 22 are provided at a bottom rear of the bracket 17 and are connected to the base panel 18 of the bracket by connection flanges 32 that are provided essentially perpendicular to the mounting flanges 22 and the base panel 18 of the bracket 17. The fan motor 31 is secured inside the bracket between a rear plate 33 that can be secured close to or flush against the rear liner 14 by the connections of the bracket 17 to the freezer liner 14, a middle plate 34 that is provided at a horizontal middle of the bracket 17 between the mounting flanges 22 and the base panel 18, a first set of arms 35 extending from the middle plate 34 toward the rear plate 33 and ending at a distance between the rear plate 33 and the middle plate 34, and a second set of arms 36 extending from the middle plate 34 to the rear plate 33 and serving to connect the middle plate 34 to the rear plate 33. The middle plate 34 is also connected to the base panel 18 of the bracket through a third set of arms 37. There is a hole in the middle plate to accommodate a shaft 53 from the motor. The shaft 53 is connected to fan blades that are located within the opening of the base panel 18. Therefore, the fan mounting assembly secures the fan motor at a position between a middle plate and a rear plate, to thereby inhibit the fan motor from contacting the evaporator coil cover. One objective of this configuration is to reduce noise in the freezer compartment and to improve airflow throughout the refrigerator appliance.

Figure 5:
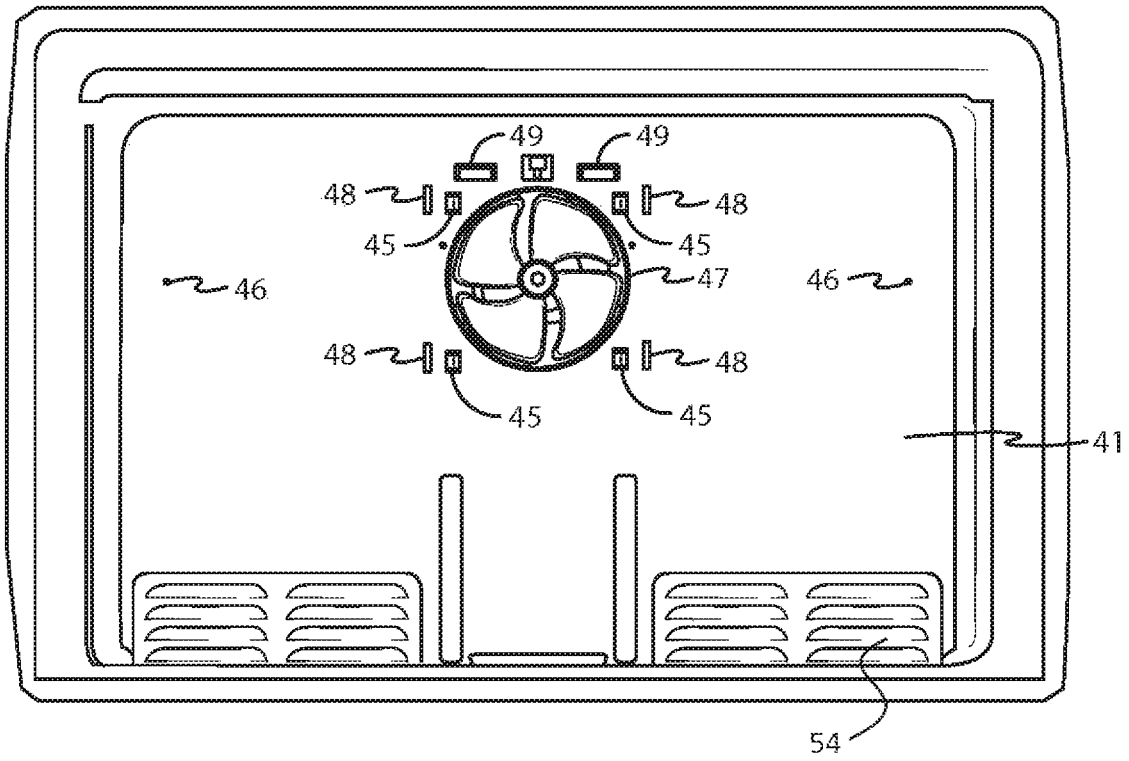
FIG. 5 shows a front view looking into a freezer compartment in which a evaporator coil cover is coupled to the fan mounting assembly.

Referring to FIG. 4, a first snap coupling having a first member and a second member is provided on the base panel 18. The snap coupling includes corresponding structures on the base panel 18 of the mounting bracket 17 and the evaporator coil cover 41, by pressing or sliding or rotating the evaporator coil cover relative to the mounting bracket 17. For example, the first member can be provided on the mounting bracket 17 as notched tabs 25 extend outwardly into the freezer compartment, for receiving the corresponding second member of the first snap coupling, such as snap holes 45 on an evaporator coil cover 41 as seen in FIG. 5. The first snap coupling serves to fasten the evaporator coil cover 41 to the bracket 17 and, subsequently, the rear liner 14. It is contemplated that there can be another embodiment where the first member of the first snap coupling on the base panel 18 are snap holes whereas the corresponding second member of the first snap coupling on the evaporator coil cover 41 are notched tabs. One objective of the first snap coupling is to reduce the reliance on the screws used to mount the coil cover directly to the rear liner and therefore lessen the thermoforming process of the liner.

As shown in FIG. 5, the evaporator coil cover 41 has an opening 47 for fan blades that is located in an upper center of the evaporator coil cover that is surrounded by various slots. The opening on the evaporator coil cover is at least partially overlapping the opening 19 of the fan mounting assembly for the fan blades. In one embodiment, the opening 47 on the evaporator coil cover is coaxial with the opening 19 of the fan mounting assembly. One objective of this configuration is to make the service of evaporator fan blade and air tower easier as one may access the fan blade and fan motor without removing the coil cover.

In a lower portion of the evaporator coil cover 41, vents 54 are provided that allow a circulation of air pulled by the fan through the evaporator.

Figure 6:
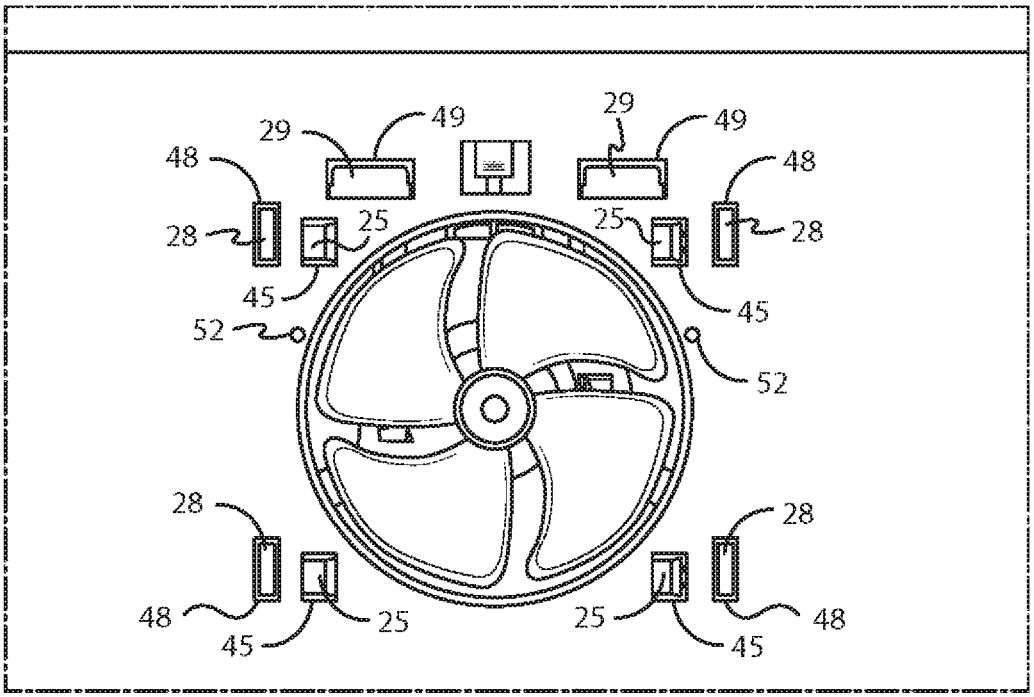
FIG. 6 shows a front, detail view of a portion of an illustrative embodiment of the evaporator coil cover after the evaporator coil cover is coupled to the fan mounting assembly.
Figure 9A:
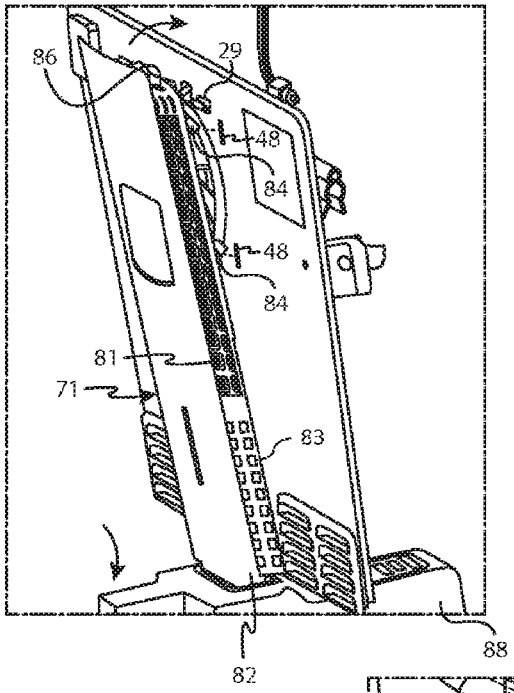
FIG. 9*a* shows a perspective view of an illustrative embodiment of an air tower assembly, when the air tower assembly is about to be mounted to the fan mounting assembly through the evaporator coil cover.

As seen in FIG. 6, the evaporator coil cover 41 has a first set of slots 48, wherein through slots 48, mounting hooks 84 of the air tower assembly 71 (as shown in FIG. 9*a*) may hook into snap holes 28 on the fan mounting assembly 15 (as shown in FIG. 3*b*). The evaporator coil cover 41 also has a second set of slots 49, wherein through the slots 49, the snap clips 29 of the fan mounting assembly 15 (as shown in FIG. 3*b*) may snap into the snap holes 86 of the air tower assembly 71 (as shown in FIG. 9*a*).

Figure 7:
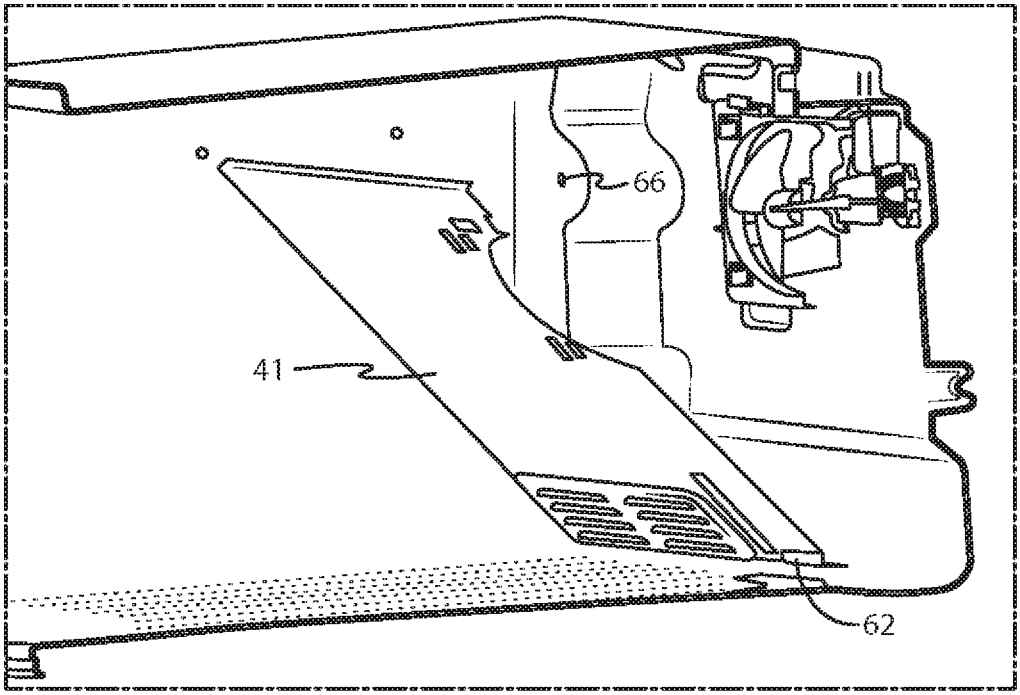
FIG. 7 shows a perspective cross-sectional view of an illustrative embodiment of the evaporator coil cover prior to mounting the evaporator coil cover to the fan mounting assembly.

As seen in FIG. 7, to install the evaporator coil cover 41, a bottom flange 62 of the evaporator coil cover is inserted into a recess in the bottom of the freezer compartment at a tilt. The evaporator coil cover 41 is then rotated toward the mounting assembly till the snap holes 45 are snapped to the notched tabs 25 of the mounting assembly 15, as shown in FIG. 6. Once the evaporator coil cover 41 is mounted to the mounting assembly 15, screws can be inserted into holes 52 in the evaporator coil cover 41 and further into corresponding tapped holes on the bracket 17, to further secure the evaporator coil cover to the mounting assembly 15.

Figure 8:
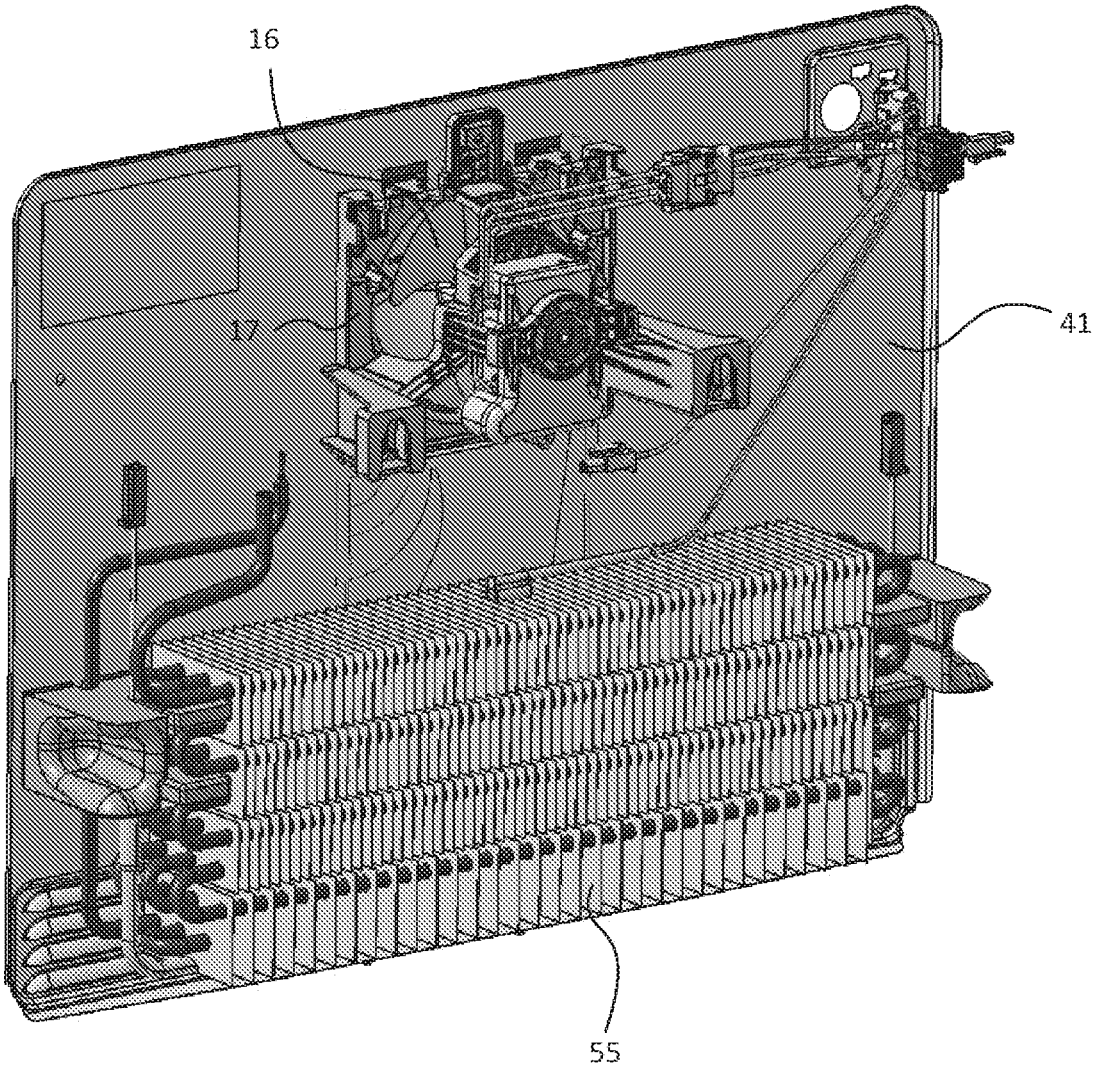
FIG. 8 shows a back view of the evaporator coil cover.

As seen in FIG. 5, screw holes 46 can be provided at locations spaced away from the mounting assembly at opposite sides of the evaporator coil cover 41. These holes correspond with tapped holes 66 provided in "kidney" portions of the real liner 14 of the freezer compartment, as seen in FIG. 7. In one embodiment, anchor nuts are provided and secured by the foam insulation 21 behind the tapped holes 66 in the freezer compartment. Screws can be inserted through the evaporator coil cover into the anchor nuts to secure the evaporator coil cover 41 to the rear liner 14. In the shown example in FIG. 8, evaporator coil 55 can be provided below the bracket 17, and between the evaporator coil cover 41 and the rear liner 14. The mounting assembly prevents the evaporator coil 55 from in direct contact with the fan motor 31. This improves energy efficiency. The evaporator coil 55 is further separated from the air tower assembly 71 by the coil cover 41 to reduce frost build up on the air tower assembly 71.

As seen in FIG. 9, the air tower assembly 71 is mounted to the mounting assembly 15 through the evaporator coil cover 41.

In one embodiment, a first member of a second snap coupling, shown as snap holes 28 are provided on the base panel 18 (see FIG. 3*b*). These snap holes 28 serve to fasten an air tower assembly 71 to the bracket 17. The snap holes 28 (FIG. 3*b*) are constructed to receive a corresponding second member of the second snap coupling, shown as mounting hooks (FIG. 10*b*) 84 on both upper sides of the air tower assembly 71. The mounting hooks 84 extend from the air tower assembly 71 towards a base panel 18 of the fan mounting assembly. It is contemplated that there can be another embodiment where the first member of the second snap coupling on the base panel 18 are mounting hooks whereas the corresponding second member of the second snap coupling on the air tower assembly 71 are snap holes.

Figure 10A:
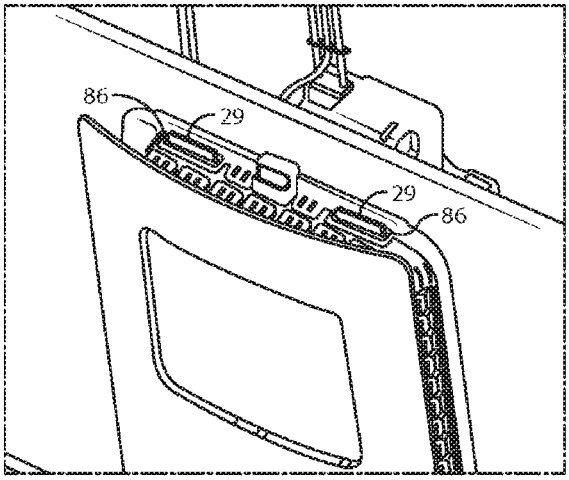
FIG. 10*a* shows a detail view of a portion of an illustrative embodiment of the air tower assembly, after both two members of the second snap coupling and two members of the third snap coupling are respectively engaged, and thereby the air tower assembly is coupled to the fan mounting assembly.
Figure 10B:
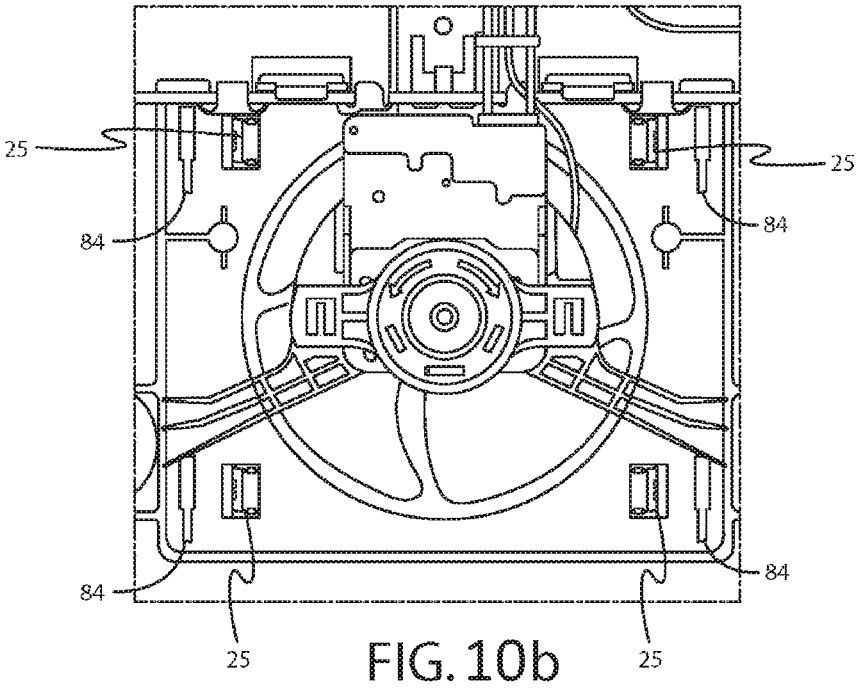
FIG. 10*b* shows a detail, rear view of a portion of an illustrative embodiment of the fan mounting assembly, after both the evaporator coil cover and the air tower are coupled to the fan mounting assembly.

Referring further to FIG. 10*a*, a first member of a third snap coupling, shown as snap clips 29 are provided on both upper sides of the fan mounting assembly 15 and extend upwardly (see FIG. 3*b*). In one embodiment, these snap clips 29 serve to fasten an air tower assembly 71 to the bracket 17. These snap clips 29 are constructed to receive a corresponding second member of the third snap coupling, shown as snap hole 86 on both upper sides of the air tower assembly 71. When inserted into the corresponding snap, the snap clips 29 lock the air tower assembly 71 to the fan mounting assembly through the evaporator coil cover. It is contemplated that there can be another embodiment where the first member of the third snap coupling on the fan mounting assembly 15 are snap holes whereas the corresponding second member of the third snap coupling on the air tower assembly 71 are snap clips.

As seen in FIG. 9*a*, the air tower assembly 71 serves to distribute cool air discharged from the evaporator fan 16 throughout the freezer compartment 11 and fresh food compartment of the refrigerator. Specifically, vents 81 are disposed on top and upper sides of the air tower assembly 71 to distribute cool air to the freezer compartment 11. Vents 83 are disposed on lower sides of the air tower assembly 71 to return air from the freezer compartment 11 to the air tower assembly 71 for recirculation. Bottom edge 82 of the air tower assembly 71 is insertable into a foamed-in air duct 88 to permit the air tower assembly 71 to provide cool air discharged from the evaporator fan 16 to the fresh food compartment of the refrigerator. Even though this embodiment illustrates the configuration in a top mount refrigerator appliance having the foamed-in air duct 88 below the freezer compartment 11, it is contemplated that the air duct may be located at either side of the freezer compartment (for side-by-side refrigerator) or at the top of the freezer compartment (for bottom-mount refrigerator) without departing from the scope of the present invention.

Figure 9B:
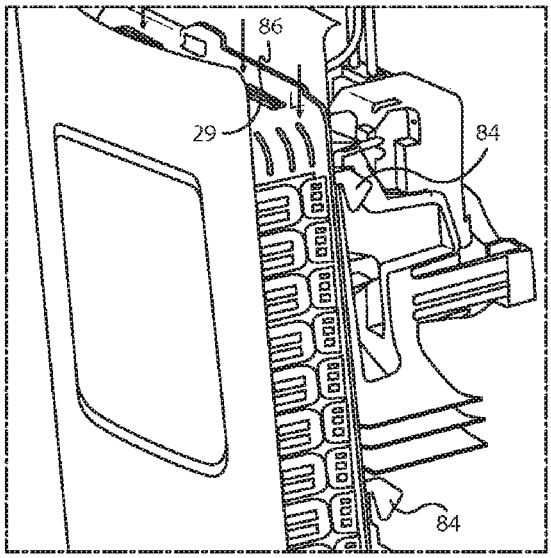
FIG. 9*b* shows a perspective, detail view of a portion of an illustrative embodiment of the air tower assembly, when a second snap coupling and a third snap coupling are both about to engage.

In one embodiment, to install the air tower assembly, first make sure the snap clips 29 of the fan mounting assembly 15 are previously installed through the corresponding slots 49 of the evaporator coil cover 41. Then, insert the bottom edge 82 of the air tower assembly 71 into the foamed-in air duct leading to the fresh food compartment. Further, rotate the assembly upward toward the evaporator coil cover 41 to align the mounting hooks 84 with the corresponding slots 48 of the evaporator coil cover 41 and snap holes 28 on the fan mounting assembly 15, as shown in FIG. 9*a*. Once the mounting hooks 84 are inserted into both the slots 48 and snap holes 28, the snap clips 29 would be automatically aligned to the snap holes 86. The air tower assembly 71 can then be pushed down to hook the air tower assembly 71 to the fan mounting assembly 15, as seen in FIG. 9*b*. When the air tower assembly 71 is pushed down to hook the air tower assembly 71 to the fan mounting assembly 15, the snap clips 29 enter the corresponding snap holes 86 of the air tower assembly 71 and lock the air tower assembly 71 to the fan mounting assembly trough the evaporator coil cover 41. This attachment of the air tower assembly 71 to the fan mounting assembly 15 through the evaporator coil cover 41 serves to retain the air tower assembly 71 in an upright position and seal the air tower to the evaporator coil cover 41, subsequently not allowing any air flow to bypass the air tower, as shown in FIG. 10*a*.

There is a slot provided on the air tower assembly 71 for a flat head screwdriver to depress the snap clips 29 on the fan mounting assembly in order to release the snap clips 29 and begin the removal of the air tower assembly 71 from the evaporator coil cover 41 and the fan mounting assembly 15.

In one embodiment, the air tower assembly 71 is made out of polyethylene material to reduce frost build up.

What is claimed is:

1. A refrigerator appliance comprising:
a freezer compartment defined by a liner;
a fan mounting assembly mounted to the liner, the fan mounting assembly comprising:
a bracket,
a snap hole formed in the bracket, and
a snap clip extending outwards from the bracket;
an air tower assembly mounted to the fan mounting assembly, the air tower assembly comprising:
a mounting hook extending from a rear side of the air tower assembly,
a snap hole formed in the rear side of the air tower assembly;
wherein the mounting hook of the air tower assembly engages the snap hole of the bracket and the snap clip of the bracket engages the snap hole of the air tower assembly to thereby couple the air tower assembly to the fan mounting assembly; and
an evaporator coil cover interposed between the fan mounting assembly and the air tower assembly, wherein the mounting hook of the air tower assembly and the snap clip of the fan mounting assembly extend through slots formed in the evaporator coil cover when the air tower assembly is coupled to the fan mounting assembly.

2. The air tower assembly of claim 1, wherein the snap clip extends upwardly from the fan mounting assembly.

3. The air tower assembly of claim 1, wherein the mounting hook extends perpendicularly from a rear side of the air tower assembly towards a base panel of the fan mounting assembly.

4. The air tower assembly of claim 1, further comprising a flange formed at a lower end thereof that is insertable into an opening formed in an air duct of the refrigeration appliance, said air duct in fluidly communicating with a fresh food compartment of the refrigerator appliance to discharge air from the air tower assembly into the fresh food compartment.

5. The air tower assembly of claim 1, wherein the air tower assembly is made out of polyethylene material.

6. The refrigerator appliance of claim 1, wherein the air tower assembly further comprises a first vent formed in an upper side of the air tower assembly, and the first vent is configured to distribute cool air to the freezer compartment.

7. The refrigerator appliance of claim 6, wherein the air tower assembly further comprises a second vent formed in a lower side of the air tower assembly, and the second vent is configured to return air from the freezer compartment to the air tower assembly.

8. A refrigerator appliance comprising:
a liner;
a fan mounting assembly comprising:
a bracket,
a snap hole formed in the bracket, and
a snap clip extending outwards from the bracket; and
an air tower assembly mounted to the fan mounting assembly, the air tower assembly including a mounting hook and a snap hole,
wherein the mounting hook of the air tower assembly engages the snap hole of the bracket and the snap clip of the bracket engages the snap hole of the air tower assembly to thereby couple the air tower assembly to the fan mounting assembly; and
an evaporator coil cover interposed between the fan mounting assembly and the air tower assembly, wherein the mounting hook of the air tower assembly and the snap clip of the fan mounting assembly extend through slots formed in the evaporator coil cover when the air tower assembly is coupled to the fan mounting assembly.

9. A refrigerator appliance comprising:
a liner;
a fan mounting assembly mounted to the liner, the fan mounting assembly comprising:
a bracket,
a first snap hole and a second snap hole formed in the bracket;
an air tower assembly mounted to the fan mounting assembly, the air tower assembly including a snap clip and a mounting hook extending from a rear side of the air tower assembly,
wherein the snap clip of the air tower assembly engages the first snap hole of the bracket and the mounting hook of the air tower assembly engages the second snap hole of the bracket to thereby couple the air tower assembly to the fan mounting assembly; and
an evaporator coil cover interposed between the fan mounting assembly and the air tower assembly, wherein the mounting hook of the air tower assembly and the snap clip of the air tower assembly extend through slots formed in the evaporator coil cover when the air tower assembly is coupled to the fan mounting assembly.

* * * * *